US005964153A

United States Patent [19]

Greive

[11] Patent Number: 5,964,153

[45] Date of Patent: Oct. 12, 1999

[54] SHEET-TURNING DEVICE FOR SHEET-FED PRINTING PRESSES

[75] Inventor: Martin Greive, Schoenau, Germany

[73] Assignee: Heidelberger Druckmaschinen AG, Heidelberg, Germany

[21] Appl. No.: 09/169,061

[22] Filed: Oct. 9, 1998

[30] Foreign Application Priority Data

Oct. 24, 1997 [DE] Germany ..... 197 47 039

[51] Int. Cl.[6] ..... B41F 5/02

[52] U.S. Cl. ..... 101/230; 271/902

[58] Field of Search ..... 101/229, 231, 101/230, 261; 271/902, 186, 176, 225, 65

[56] References Cited

U.S. PATENT DOCUMENTS

| | | | |
|---|---|---|---|
| 5,082,272 | 1/1992 | Xydias et al. . | |
| 5,265,864 | 11/1993 | Roux et al. | 271/902 |
| 5,382,013 | 1/1995 | Walsh | 271/902 |

FOREIGN PATENT DOCUMENTS

| | | |
|---|---|---|
| 25 59 034 | 3/1981 | Germany . |
| 37 17 093 | 12/1988 | Germany . |
| 33 24 996 | 6/1994 | Germany . |

OTHER PUBLICATIONS

Roller, "Constant Force Spring Inverter," Xerox Disclosure Journal, vol. 8, No. 2, Mar. 1983.

Roller, "Solenoid/Scuffer Inverter," Xerox Disclosure Journal, vol. 8, No. 5, Sep. 1983.

Anonymous,"Single Roll, Snap Over Inverter," Xerox Disclosure Journal, vol. 6, No. 4, Jul. 1981.

*Primary Examiner*—Christopher A. Bennett

*Attorney, Agent, or Firm*—Kenyon & Kenyon

[57] ABSTRACT

A turning device for a sheet-fed printing press contains a turning pocket (9) which is bordered by two walls (10,11) which in the interior of the turning pocket are situated close together and which at an opening side of the turning pocket are a predetermined distance from each other forming an elongated sheet intake and output opening (12) with two edges parallel to each other. The simply constructed, reliably functioning sheet-turing device includes: a plurality of oblong elastic drivers (17) that are movable along a concave path with respect to the interior of the turning pocket (9) from one edge of the sheet intake and output opening (12) to the other and that extend lengthwise transversely to the concave path; at least two counterpressure elements (15,16) each of which is located close to an edge of the sheet intake and output opening (12) in a position along the concave path through which a tangent to the concave path into the interior of the turning pocket (9) is directed, the counterpressure elements being impacted by some of the elastic drivers (17); and a sheet stop (18) in the turning pocket, whose distance from the counterpressure elements (15,16) is somewhat less than the length of the sheets which are to be turned.

12 Claims, 4 Drawing Sheets

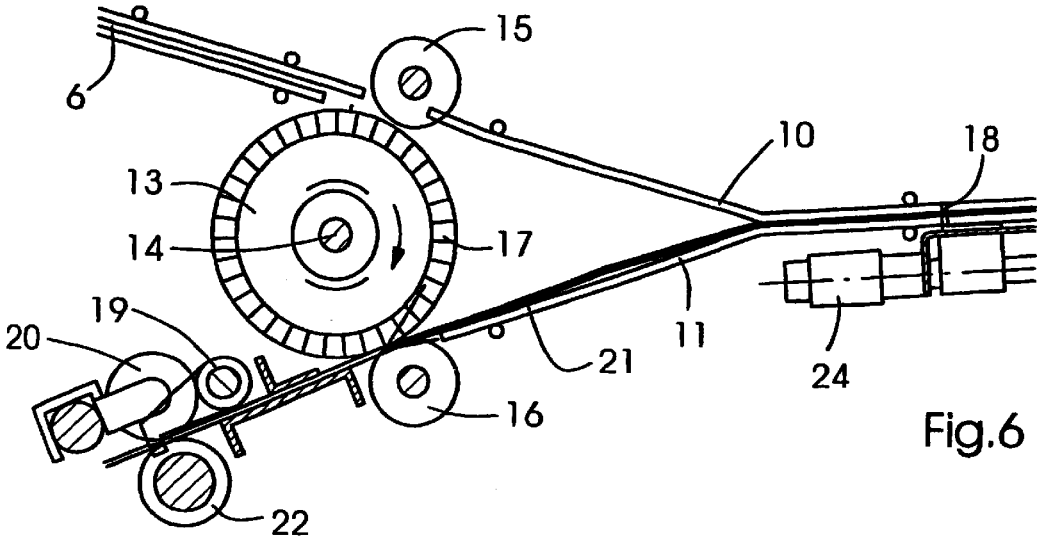
Fig.6
Fig.7
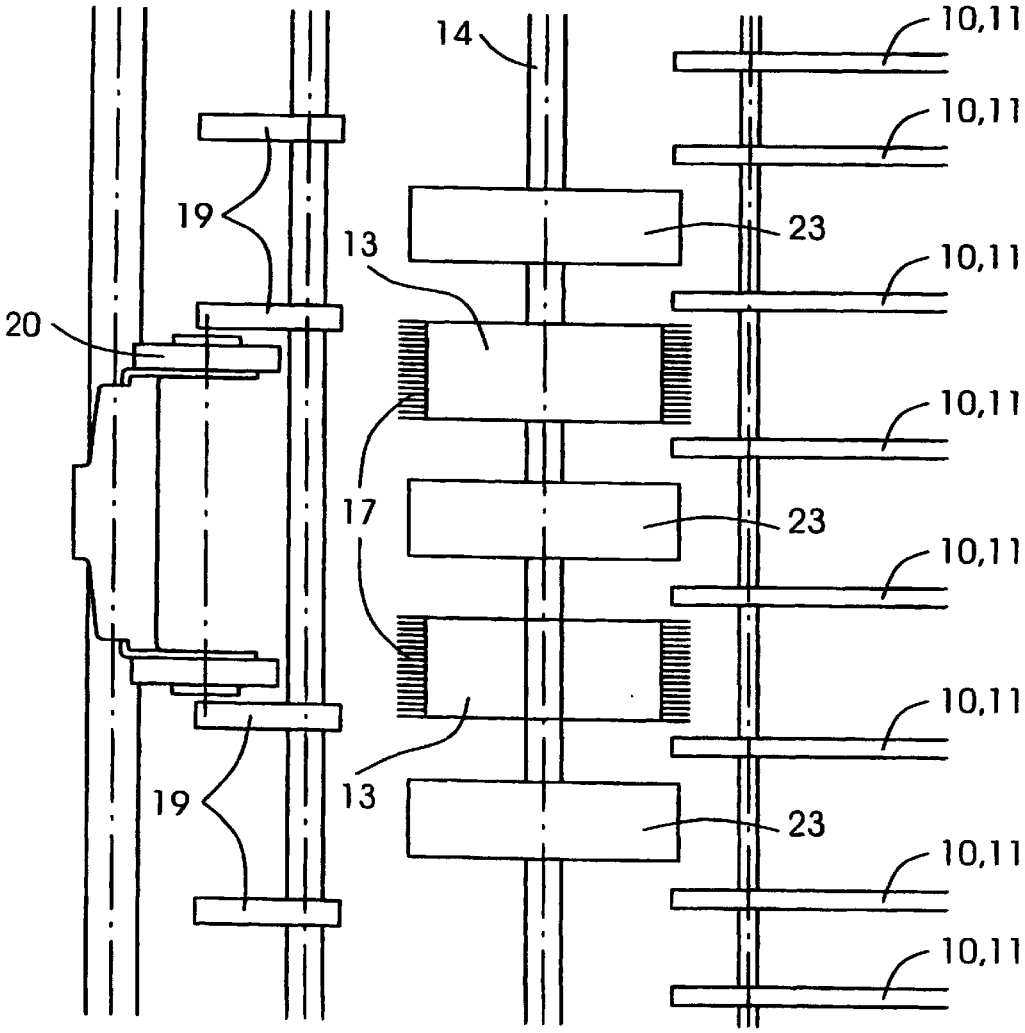

SHEET-TURNING DEVICE FOR SHEET-FED PRINTING PRESSES

FIELD OF THE INVENTION

The present invention concerns a sheet-turning device for sheet-fed printing presses.

RELATED TECHNOLOGY

Sheet-turning devices are known which direct a sheet that is to be turned onto a blind transport path, i.e., onto a path which forms a dead end, and then direct it back in reversed direction, i.e., with the formerly trailing edge in front.

In a conventional printing press with grippers, this can take place, by way of example, through the sheet being brought from a sheet-transfer cylinder with the leading edge in front to a sheet delivery unit from which it is picked back up with the trailing edge in front. During this process, the trailing edge of the sheet is held fast in pivoting grippers of the sheet transfer cylinder. A sheet-turning device of this kind is disclosed, for example, in German Patent Application No. 37 17 093 A1.

An electro-photographic recording device such as a copying machine or a laser printer is disclosed in German Patent No. 33 24 996 C2 which has a sheet-turning device in which the dead-end transport path is bordered by two parallel walls. An arrangement of this kind with two more or less parallel walls between which a sheet to be turned is pushed is generally called a turning pocket. While the sheet is in the turning pocket, the trailing edge of the sheet is shifted in the direction toward a sheet output path. In the disclosed recording device, this is accomplished through the sheet being pressed against a wall surface with the aid of a fan. Since airstreams and their actual effects on a sheet are difficult to control, the functional reliability of such a turning device cannot always be assured, in particular if various stocks and/or formats must be handled. In addition, the turning device requires a plurality of input and output cylinders which rotate in different directions and alternately are pressed against a sheet to push it in and out. Therefore this device is relatively complex and correspondingly susceptible to interference.

In German Patent No. 25 59 034 B2, a turning device with a dead-end transport path is described which is composed of a sloping chute. The operating speed of a gravity-assisted turning device of this kind is naturally limited as is its functional reliability. In addition, at least one redirect element is required at the entrance of the chute as well as elements for pulling the sheets from the chute. All of these elements must be driven, making the device susceptible to failure.

SUMMARY OF THE INVENTION

An objective of the present invention is to create a simply constructed and functionally reliable sheet-turning device which is particularly suitable for printing presses without grippers.

According to the present invention, a turning device for a sheet-fed printing press is provided which contains a turning pocket bordered by two walls which, in the interior of the turning pocket, lie close together and which at the open side of the turning pocket are at a predetermined distance from each other forming a long sheet intake and output opening with two edges parallel to each other. A plurality of oblong, elastic drivers can move along a concave path with respect to the interior of the turning pocket from one edge of the sheet intake and output opening to the other and extend with their length transverse to the concave path. Also included are at least two counterpressure elements, each of which is located in the proximity of an edge of the sheet intake and output opening in a position along the concave path through which a tangent to the concave path directed into the interior of the turning pocket passes, with the counterpressure elements being impacted by some of the elastic drivers and a sheet stop in the turning pocket whose distance from the counterpressure elements is somewhat less that the length of the sheet which is to be turned.

When the elastic drivers are moved along the concave path, they fulfill three functions at the same time: First they, acting together with the one or more counterpressure elements, transport a sheet which is to be turned into the turning pocket; second, they cause a reliable, positive relocation of the trailing edge of a sheet which has been transported into the turning pocket in a manner not achieved in any of the known turning devices; and third, they, acting together with one or more additional counterpressure elements, transport the sheet after redirection of its trailing edge back out of the turning pocket. As a result, only very few additional components are needed in addition to the turning pocket itself. The only components which must be driven are the drivers, and their direction of movement remains the same during the entire turning process so that oscillations are avoided.

In a preferred embodiment, the concave path is formed by a portion of the cylindrical outer surface of at least one cylinder which is arranged just in front of the sheet intake and output opening and is borne rotatably on an axle parallel to the length of the sheet intake and output opening.

The elastic drivers can be simply formed by the bristles of a brush, being either a brush cylinder which forms the cylinder in front of the sheet intake and output opening or being a brush belt which runs around an appropriate cylinder. The elastic drivers do not have to be peg-shaped as is generally the case with the bristles of a brush, but rather they can also have the form of more or less wide strips which are fastened to the cylinder or the belt with the width of the strips oriented in the direction of the axis of the cylinder. In the case of the use of a belt as a base for the drivers, it is also possible to replicate the concave path through the belt being carried around several cylinders in sequence which are arranged along a curved line in front of the sheet intake and output opening.

As counterpressure elements, cylinders are also preferably used which have a fixed axle parallel to the length of the sheet intake and output opening and which are freely rotatable so as to be carried along by the brush cylinder or the brush belt when the cylinder or belt is driven. When the brush and the counterpressure cylinders move, a sheet which is to be transported is carried along by friction. If the brush or the like generates sufficient friction, it is conceivable that, instead of using rotating counterpressure elements, fixed sliding surfaces may be used over which a sheet glides while it is being pushed and carried along by the brush. Sliding surfaces of this kind can also be formed by the walls of the turning pocket itself.

The turning device according to the present invention can easily be equipped for the turning of various sheet formats by making the sheet stop movable in the direction toward or away from the sheet intake and output opening. The sheet stop is adjusted so that a sheet that is brought to it reaches the sheet stop and its trailing edge dips between the elastic drivers as it is shifted from one wall of the turning pocket to the other.

Due to the concave movement path of the drivers from one wall of the turning pocket to the other, the distance between the sheet stop and the tips of the elastic drivers at the vertex of the their path of movement is somewhat less than the distance between the sheet stop and the counterpressure elements. In this way, the sheet in the course of its relocation in the turning pocket forms an undulation which allows the sheet to turn to the new side with extreme reliability. To prevent the sheet edge from penetrating during this process too far between the drivers and being thereby damaged, sheet spacers can be provided which are arranged distributed along the length of the sheet intake and output opening and having curved exterior sides, the spacers running along the concave path, with the elastic drivers extending somewhat beyond them.

The elastic drivers do not have to be arranged distributed over the entire width of the sheet, but rather several comparatively narrow brush cylinders can be used which are arranged axially at intervals one behind the other. In such a case, the aforementioned sheet spacers can be formed by suitably shaped guide plates between the individual brush cylinders. Alternatively, the sheet spacers can be integral parts of a brush cylinder or brush belt, for example ridges which are arranged between the bristles and which extend in the direction of movement of the bristles.

By way of example, the turning pocket can be configured with an approximately U-shaped or V-shaped cross section. Its walls can be—but do not have to be—made of one piece, for example of one or more sheet-metal plates, but can also, for example, be formed by several longitudinally extended struts which extend in the direction of the sheet intake and output.

In a preferred embodiment, the turning pocket is configured so that its two walls run parallel to each other in a greater zone and diverge in a smaller zone adjacent to the sheet intake and output opening in an approximately V-shaped manner in the direction of the counterpressure elements. As a result, there is a precisely delimited zone in which a sheet can form an undulation as it is being redirected in the turning pocket. In this way, a very precisely defined redirection movement occurs in the turning pocket, increasing the reliability of the turning operation still further.

The turning device according to the present invention is particularly suitable for gripperless printing presses, in particular for digital printing presses with transport belts for internal sheet transport. In a printing press of this type, great value is placed on a design that is as compact as possible. The turning device according to the present invention can be integrated into a compact digital printing press in an extremely space-saving manner and/or without modifying its external dimensions. Therefore it can be designed, for example, as a retrofit or replacement component for a digital printing press.

BRIEF DESCRIPTION OF THE DRAWINGS

A description of an example embodiment with the aid of drawings follows, in which:

FIG. 3, 4, 5 and 6 show detailed views of the turning device of FIG. 1 which show the sequential phases of the turning operation; and FIG. 7 shows a top view of the detail shown in FIGS. 3 through 6.

DETAILED DESCRIPTION

Figure 1:
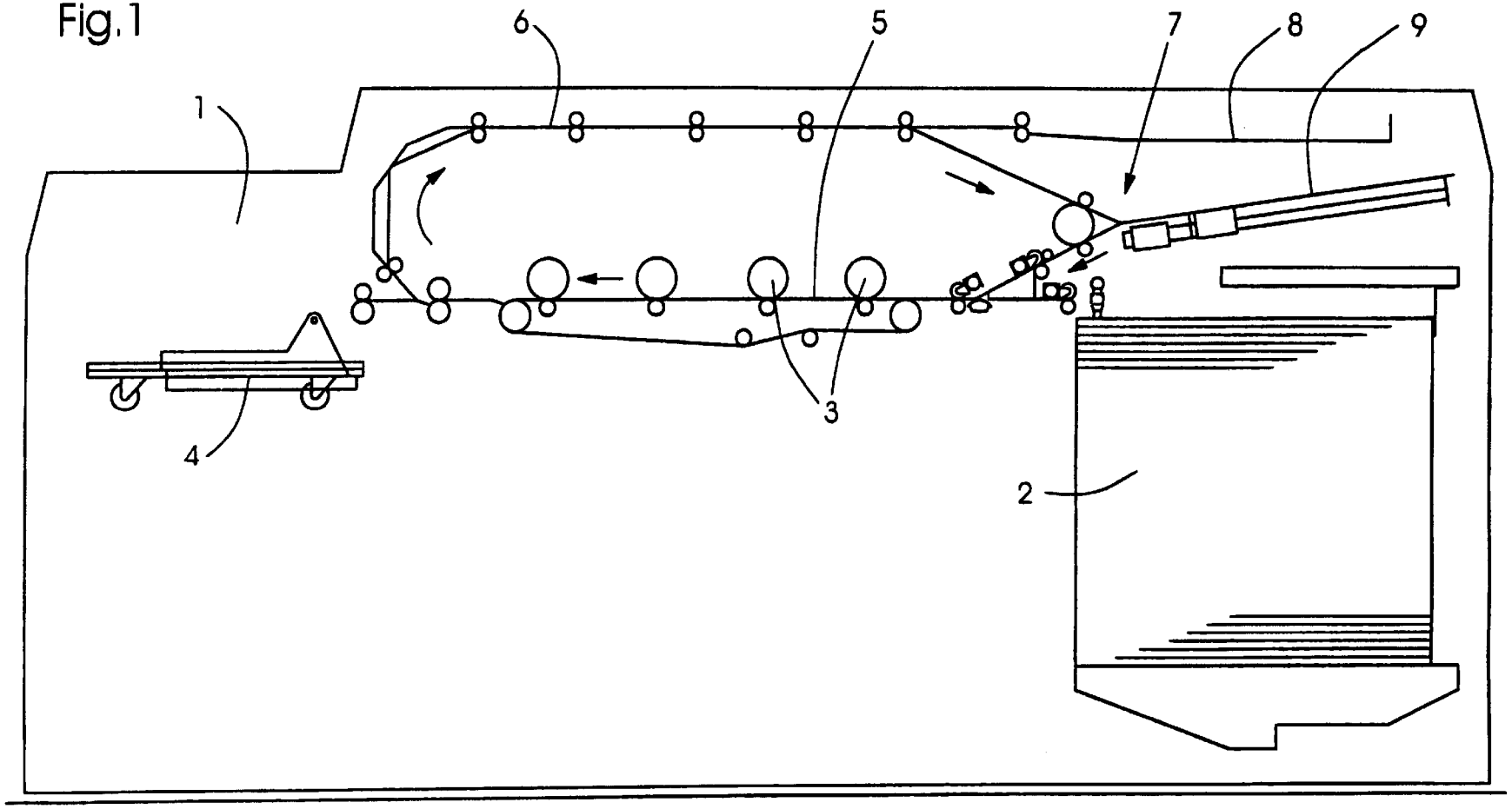
FIG. 1 shows a longitudinal section through a digital printing press containing a sheet turning device.

A digital printing press shown in FIG. 1 contains a housing 1 in which, among other things, a feed unit 2, several digital printing units 3, and a delivery unit 4 are located. Sheets which are to be printed on one side are transported by a transport belt 5 from feed unit 2 through printing units 3 and then are transferred to delivery unit 4. Alternatively, sheets, the first side of which have been printed in printing units 3, are directed onto a return section 6, are turned in a turning device 7, and are then transported a second time through printing units 3, and afterwards are transported into delivery unit 4. The various possible sheet-transport directions are indicated with arrows. A sheet on return section 6 can be directed into a withdrawal compartment 8 in housing 1 which is open to the top for a quick inspection of the first side by a press operator.

Figure 2:
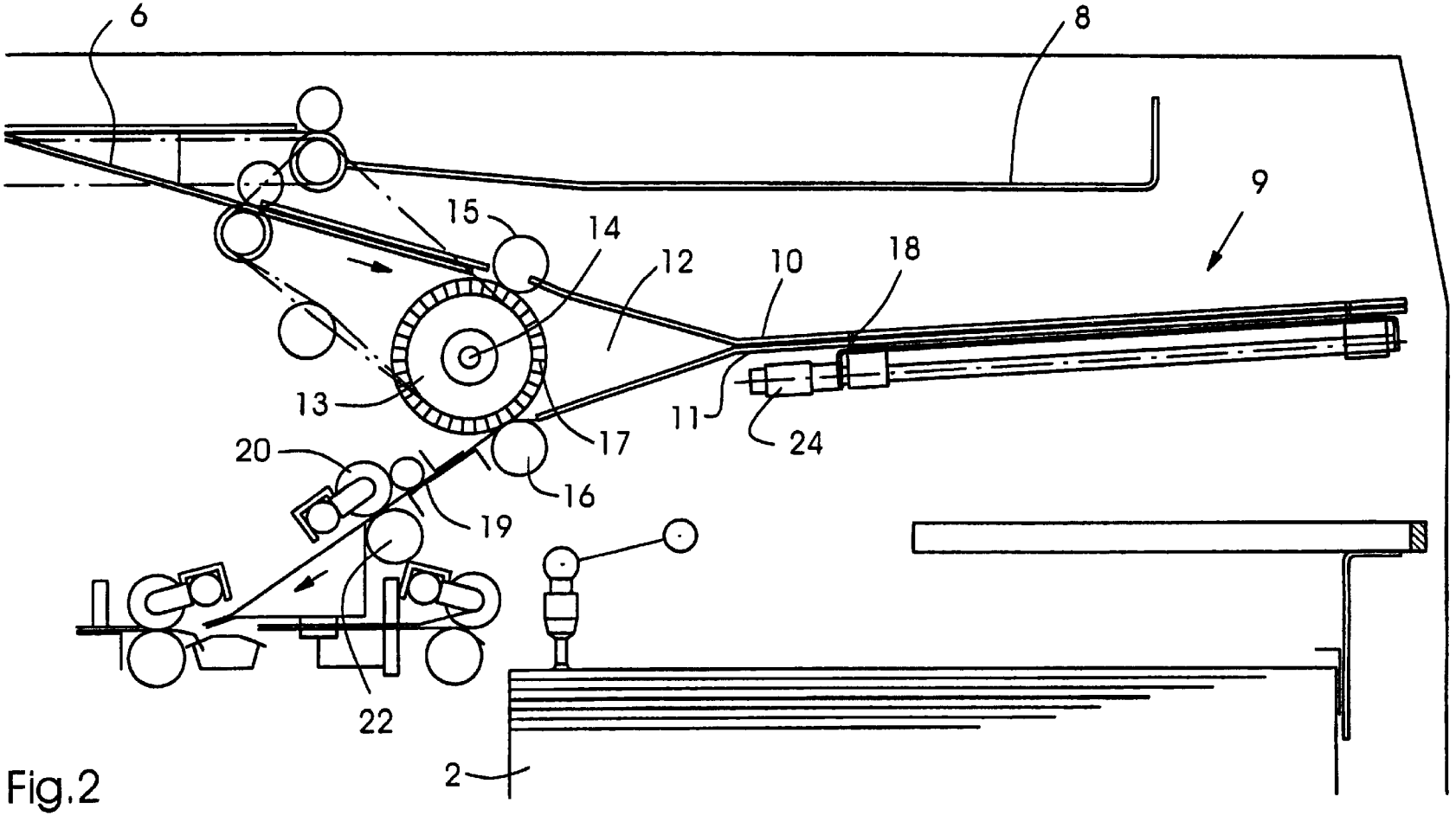
FIG. 2 shows a detailed view of the turning device of FIG. 1.

In FIG. 2, turning device 7, shown enlarged, which is accommodated in a space-saving manner above feed unit 2, has a turning pocket 9 with two walls 10 and 11 which over the larger portion of their surfaces extend parallel to each other and are situated a short distance apart from each other, forming the interior part of turning pocket 9. In a section for the intake and output of sheets, walls 10 and 11 diverge in a V-shaped manner. The outer edges of the V-shaped diverging wall portions border sheet intake and output opening 12 which extends perpendicularly to the plane of the figure across the width of the sheet.

A short distance in front of sheet intake and output opening 12, two brush cylinders 13 are fastened with a space between them to an axle which extends perpendicularly to the plane of the figure, i.e., parallel to oblong sheet intake and output opening 12. While only one brush cylinder 13 can be seen in FIG. 1, in the view shown in FIG. 7, both brush cylinders 13 can be seen from above. Axle 14 of brush cylinders 13 is connected on one side to a drive for turning the brush cylinders in the indicated clockwise direction. Close to the outer edges of the V-shaped diverging portions of walls 10, 11, each of counterpressure cylinders 15, 16 are borne so as to rotate freely on axles which run parallel to axle 14 of brush cylinders 13. Counterpressure cylinders 15, 16 are arranged so that elastic bristles 17 of brush cylinders 13 press against them. In this process, bristles 17 are elastically deformed slightly at least at such time as a sheet is situated between brush cylinders 13 and counterpressure cylinder 15 or 16.

The extension of return transport section 6 in the direction of turning pocket 9 is directed tangentially past contact area between brush cylinders 13 and upper counterpressure cylinders 15 into the interior of turning pocket 9, forming a sheet intake path. A sheet output path runs approximately along a tangent through the contact area between brush cylinders 13 and lower counterpressure cylinders 16 out of turning pocket 9.

In the zone of the portions of the two walls 10, 11 of turning pocket 9 which run parallel to each other, there is a sheet stop 18 which is adjustable in the direction of sheet intake and output opening 12 and away from it. Sheet stop 18 is set so that the distance between sheet stop 18 and the contact areas between brush cylinders 13 and upper or lower counterpressure cylinders 15, 16 is somewhat less than the length of the sheets to be processed. Since brush cylinders 13 arch into sheet intake and output opening 12, the distance between sheet stop 18 and the outer side of brush cylinders 13 in the middle of sheet intake and output opening 12 is still somewhat less than the distances between sheet stop 18 and counterpressure cylinders 15 or 16.

A movable front stop 19 and a roller with a swiveling axle which can be driven for rotation are arranged on the sheet output path formed by several guide plates from the contact area of brush cylinders 13 and lower counterpressure cylinders 16 to transport belt 5. Front stop 19 is movable so that a sheet which strikes it can be released on the basis of a control signal. Roller 20 can be lowered against a sheet stopped at front stop 19 upon a control signal, and on an additional control signal it commences to rotate.

Figure 3:
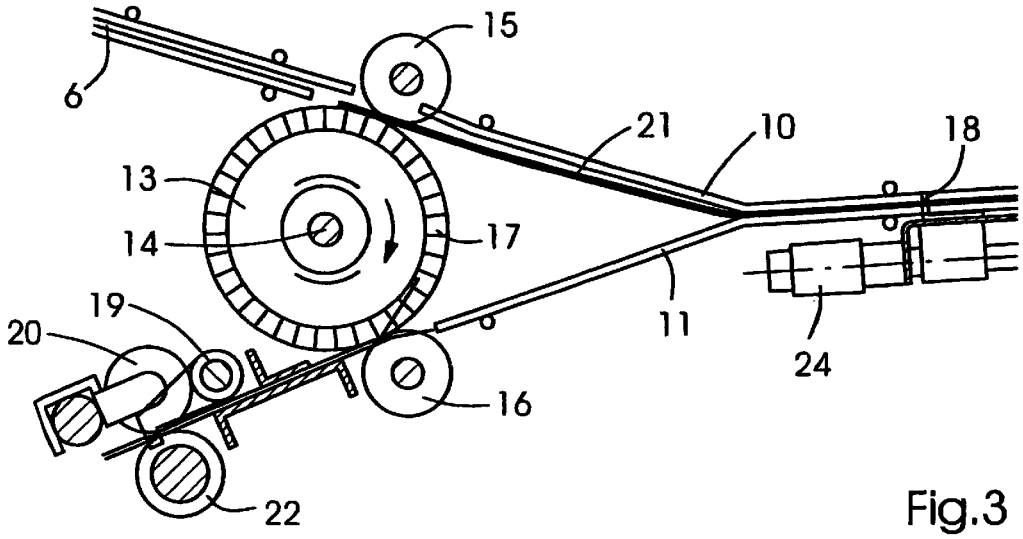

A sheet 21 which is transferred into turing pocket 9 runs between rotating brush cylinders 13 and counterpressure cylinders 15 which rotate with them and is pushed by the friction of bristles 17 to sheet stop 18 in turning pocket 9, as can be seen in the enlargement of FIG. 3. The trailing edge of sheet 21 is carried further through the friction so that an undulation forms in sheet 21 and its trailing edge is pushed between bristles 17.

Figure 4:
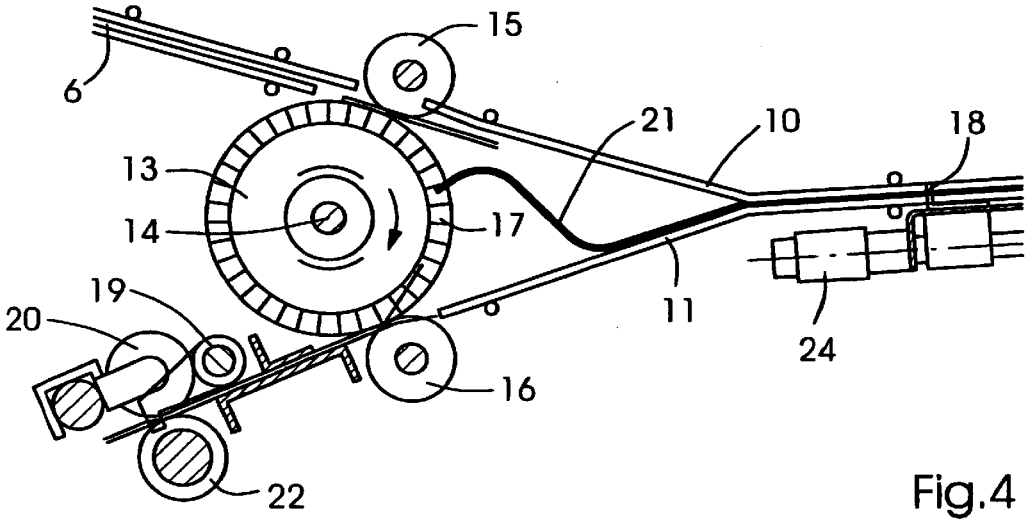
Figure 5:
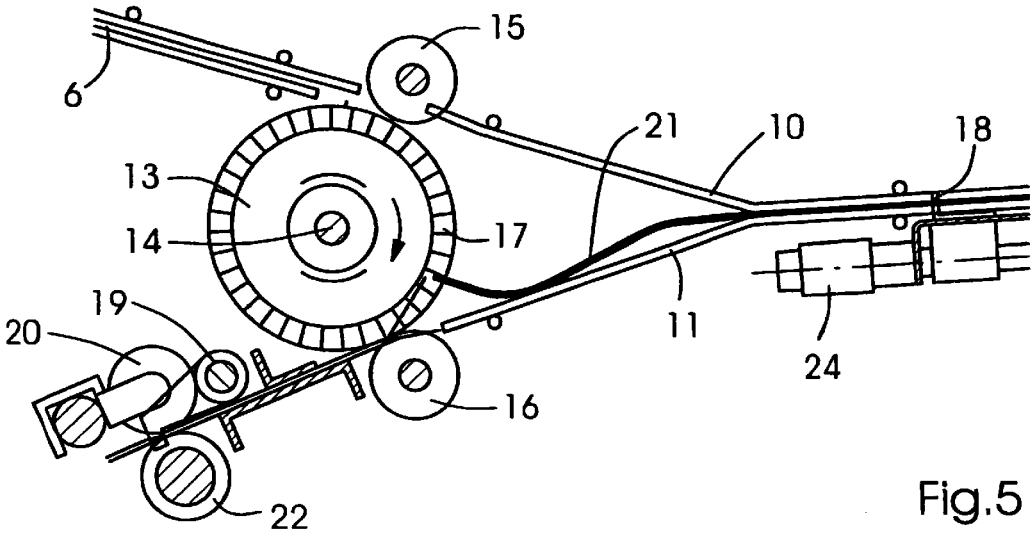

With the rotation of brush cylinders 13, the trailing edge of the sheet is advanced to the lower counterpressure cylinders as shown in FIG. 4, whereupon the undulation in sheet 21 finally switches over against the lower wall of turning pocket 9 as shown in FIG. 5.

As shown in FIG. 6, the trailing edge of the sheet then comes between brush cylinders 13 and lower counterpressure cylinders 16 and is thereby driven against front stop 19. Sheet 21 remains in this position with brush cylinders 13 rotating past rubbing against it.

At a signal from the printing press control system, roller 20 is lowered until sheet 21 is clamped between roller 20 and a counterpressure roller 22. Afterward, front stop 19 is pushed upward and roller 20, which is now driven, accelerates sheet 21 to the speed of the machine. Accelerated sheet 21 is then directed with its former trailing edge in front onto transport belt 5 so that its reverse side can be printed.

As indicated schematically in FIG. 7, several curved guide plates can be arranged in the open spaces between and to the side of brush cylinders 13 as spacers 23, preventing the edge of the sheet from penetrating too far between bristles 17 of brush cylinders 13 and being thereby damaged.

The described turning process is extremely reliable due to the positive redirection action. In addition, the described turning device runs extremely quietly since there is no reversal of direction of rotation of the cylinders involved in transport.

In many digital printing presses, the sheet can be printed on the first side directly following turnover, making front stop 19 unnecessary. Since in this case the sheet is not stopped, the entire turning movement takes place still more evenly.

Adjustable sheet stop 18 facilitates an extremely simple and quick adjustment of the printing press to different sheet formats. A coarse adjustment with a latching device for the common sheet formats can be provided, and alternatively or in addition, a fine adjustment 24 can be used with which fine adjustment to sheet elasticity can be accomplished. Since the turning action in the turning pocket is influenced by sheet elasticity, a fine adjustment of this kind may be necessary in particular for very thin or very thick, stiff papers.

What is claimed is:

1. A turning device for a sheet-fed printing press comprising:

a turning pocket formed by two walls, the two walls being close together on an interior of the turning pocket and at a certain predetermined distance apart at an opening side of the turning pocket, the two walls forming a sheet intake opening and a sheet output opening, the sheet output opening having parallel first and second edges;

a plurality of oblong elastic drivers movable along a curved path extending inwardly toward the interior of the turning pocket from the first edge to the second edge, a length of the first edge and the second edge extending transversely to the curved path;

at least two counterpressure elements, each of the at least two counterpressure elements located near one of the first and second edges in a position along the curved path through which a tangent to the curved path is directed into the interior of the turning pocket, the counterpressure elements being impacted by at least one of the plurality of elastic drivers; and a sheet stop in the turning pocket, a distance between the sheet stop and the counterpressure elements being somewhat less than a length of sheets to be turned.

2. The turning device as recited in claim 1 wherein the concave path is formed by a portion of a cylindrical exterior surface of at least one cylinder arranged close in front of the sheet intake and output opening, the at least one cylinder being fastened to an axle parallel to the length of the first edge.

3. The turning device as recited in claim 2 wherein the elastic drivers are fastened to the cylindrical external surface of the at least one cylinder.

4. The turning device as recited in claim 3 wherein the at least one cylinder is a brush cylinder.

5. The turning device as recited in claim 2 wherein the elastic drivers are fastened to at least one belt running around the at least one cylinder.

6. The turning device as recited in claim 5 wherein the at least one belt is a brush belt.

7. The turning device as recited in claim 1 wherein the counterpressure elements are freely rotating cylinders, an axis of rotation of the freely rotating cylinder running parallel to the length of the first edge.

8. The turning device as recited in claim 1 wherein the sheet stop is capable of being adjusted toward and/or away from the sheet intake and output opening.

9. The turning device as recited in claim 1 further comprising a plurality of sheet spacers arranged distributed along a length of the sheet intake and output opening and having curved outer sides running along the concave path, the elastic drivers projecting somewhat beyond the plurality of sheet spacers.

10. The turning device as recited in claim 1 wherein the two walls of the turning pocket extend over a major area parallel to each other and a short distance apart over a lesser area adjacent to sheet intake and output opening and diverge in an approximately V-shaped manner in a direction of counterpressure elements.

11. The turning device as recited in claim 1 wherein the sheet-fed printing press is a gripperless printing press.

12. The turning device as recited in claim 1 wherein the sheet-fed printing press is a digital printing press including transport belts for internal sheet transport.

* * * * *